US005213254A

United States Patent [19]

Regis et al.

[11] Patent Number: 5,213,254

[45] Date of Patent: May 25, 1993

[54] DUAL CONFIGURATION STORAGE CONTAINER FOR FLAT CARDS

[75] Inventors: Bruce W. Regis, Del Mar; Christopher Corman, Torrance, both of Calif.

[73] Assignee: The Upper Deck Company, Carlsbad, Calif.

[21] Appl. No.: 922,160

[22] Filed: Jul. 29, 1992

[51] Int. Cl.[5] ..... B65D 5/48

[52] U.S. Cl. ..... 229/103; 206/425; 229/120.28; 229/120.32; 229/120.38; 229/151

[58] Field of Search ..... 229/103, 151, 120.26, 229/120.24, 120.28, 120.29, 120.32, 120.38, 178; 206/425, 815, 45.11

[56] References Cited

U.S. PATENT DOCUMENTS

| | | | |
|---|---|---|---|
| 374,920 | 12/1887 | Achor . | |
| 588,423 | 8/1897 | Guilbert . | |
| 1,055,651 | 3/1913 | Porter . | |
| 1,443,216 | 1/1923 | DeBarry . | |
| 1,763,416 | 6/1930 | Brierley | 229/120.28 |
| 1,871,617 | 8/1932 | King . | |
| 2,192,307 | 3/1940 | Green | 229/120.24 |
| 2,738,917 | 3/1956 | Mader | 229/120.32 |
| 3,014,633 | 12/1961 | Tarmina | 229/178 |
| 3,197,111 | 7/1965 | Kozlowski et al. | 229/120.32 |
| 3,263,894 | 8/1966 | Matson | 229/120.38 |
| 3,385,424 | 5/1968 | Thompson et al. | 206/45.19 |
| 3,963,167 | 6/1976 | Newgaard, II . | |
| 4,120,443 | 10/1978 | Gardner et al. . | |
| 4,148,396 | 4/1979 | Gardner | 206/521 |
| 4,520,922 | 6/1985 | Beach | 206/425 |
| 4,957,213 | 9/1990 | White et al. | 206/425 |

*Primary Examiner*—Gary E. Elkins
*Attorney, Agent, or Firm*—Cahill, Sutton & Thomas

[57] ABSTRACT

A rectangular box includes an internal storage compartment. A removable insert is dimensioned to fit snugly within the internal storage compartment to define a low card storage capacity subcompartment for storing flat rectangular cards with an orientation parallel to the base surface of the box. A foldable divider can be selectively positioned between extended and retracted positions. When displaced into the extended position after removal of the removable insert, the foldable divider subdivides the internal storage compartment into first and second equal sized subcompartments to create a second high card storage capacity where the cards are oriented perpendicular to the base surface of the box.

31 Claims, 2 Drawing Sheets

DUAL CONFIGURATION STORAGE CONTAINER FOR FLAT CARDS

BACKGROUND OF THE INVENTION

1. Field of the Invention

This invention relates to storage containers, and more particularly, to dual configuration storage containers for flat cards having a first low volume storage configuration and a second high volume storage configuration.

2. Description of the Prior Art

In the retail environment, it is occasionally necessary to provide a retail display device which is also serves as a storage container for the merchandise to be promoted and sold.

In the retail market for trading or collectable cards such as cards relating to baseball, basketball, football, hockey and other sports, it may be desirable to promote the retail sale of such cards by providing secondary products which may in themselves serve as a collectable item.

To control the overall cost of the combination of trading cards and a secondary promotional item, the quantity of the trading cards packaged with the secondary product must be limited to control the selling price of the combined product.

The marketability of the combined product may be enhanced if the secondary product serves not only as an element of the retail display, but also possesses an intrinsic additional value relating to storage of a relatively large quantity of trading cards. Accordingly, significant benefits may be achieved by providing a dual configuration storage container which in the retail display configuration serves to store a limited number of trading cards, but subsequent to purchase can be readily converted by a purchaser into a second configuration having a high trading card storage capacity.

SUMMARY OF THE INVENTION

It is therefore a primary object of the present invention to provide a dual configuration storage container for flat cards which is retailed with a first low card storage capacity but which can readily be converted by the purchaser into a second configuration having a high card storage capacity.

Another object of the present invention is to provide a dual configuration storage container where the internal storage capacity of the container can be readily converted from a low storage capacity mode to a high storage capacity mode by removing a single element from the storage container and by displacing a second element of the storage container, where both the first and second elements of the storage container are incorporated into the product at the time of the retail sale.

Another object of the present invention is to provide a dual configuration storage container having a single low capacity storage compartment when sold at retail to a purchaser but which can be readily converted into a second configuration having higher capacity first and second equal size storage subcompartments.

Another object of the present invention is to provide a dual configuration storage container having a first storage configuration such that at the time of retail sale rectangular cards can be stored with their surfaces oriented parallel to the base surface of the storage container, but which can readily be converted by the purchaser into a second storage configuration where the surfaces of the cards are oriented perpendicular to the base surface of the storage container.

Another object of the present invention is to provide a dual configuration storage container which can be mass produced at low cost from cardboard material.

Briefly stated, and in accord with one embodiment of the invention, a dual configuration storage container is provided for flat cards having a rectangular surface, a length and a width. The storage container includes a rectangular box having a rectangular base surface, a rectangular side surface, a rectangular rear surface, opposing, spaced apart rectangular end surfaces and a top surface movable between open and closed positions. The top surface is oriented parallel to but spaced apart from the base surface when in the closed position. The box defines a rectangular internal storage compartment having a first storage volume defined by a length, a width and a height. The base surface includes a midline extending between the front and rear surfaces of the box dividing the base surface into two equal areas.

A foldable divider includes a width substantially equal to the width of the internal storage compartment and a length substantially equal to the height of the internal storage compartment. The foldable divider includes a lower edge surface and is movable between a retracted position substantially parallel to the base surface of the box and an extended position. In the extended position, the foldable divider is oriented perpendicular to the base surface with the lower edge surface laterally aligned with the midline of the base surface. The foldable divider thus selectively subdivides the internal storage compartment of the box into first and second equal size subcompartments when displaced into the extended position. Each subcompartment includes a length substantially equal to the card length and a height substantially equal to the card width for storing cards with the card surfaces oriented perpendicular to the box base surface.

A removable insert is dimensioned to fit snugly within the box internal storage compartment for defining a third subcompartment accessible through the top surface of the box when in the open configuration. The third subcompartment includes a base surface elevated above the box base surface and first and second sides oriented parallel to the front and rear surfaces of the box. The third subcompartment also includes a length equal to or greater than the length of the cards and third and fourth sides oriented parallel to the end surfaces of the box. The length of the third and fourth sides is equal to the width of the cards. The third subcompartment further includes a depth adequate to store at least one card with the card surface oriented parallel to the box base surface.

The card storage capacity of the box can be substantially increased by removing the removable insert and displacing the foldable divider from the retracted position into the extended position.

DESCRIPTION OF THE DRAWINGS

The invention is pointed out with particularity in the appended claims. However, other objects and advantages together with the operation of the invention may be better understood by reference to the following detailed description taken in connection with the following illustrations, wherein:

DESCRIPTION OF THE PREFERRED EMBODIMENT

In order to better illustrate the advantages of the invention and its contributions to the art, a preferred embodiment of the invention will now be described in some detail.

Figure 1:
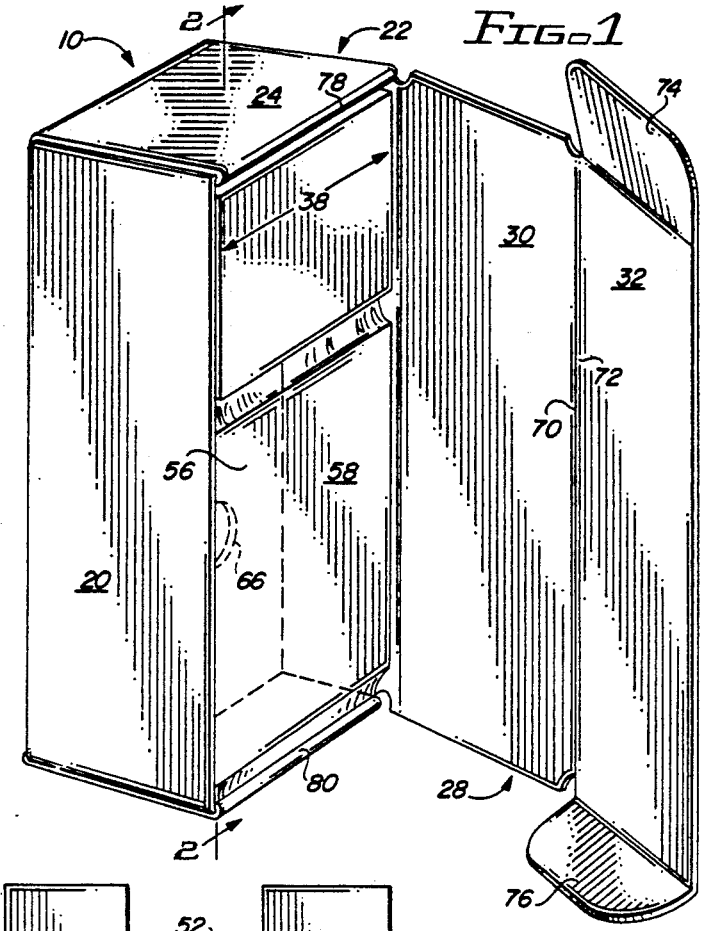
FIG. 1 is a perspective view of the dual configuration storage container of the present invention showing the top surface in the open position.
Figure 2:
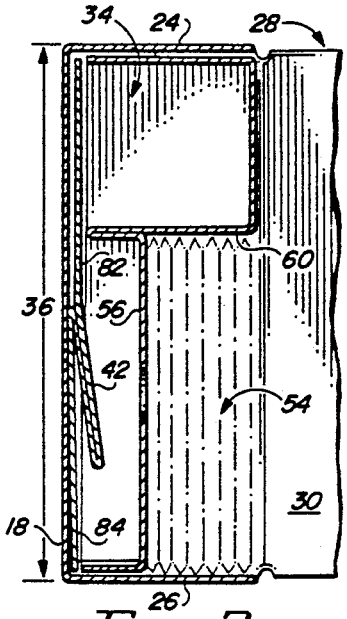
FIG. 2 is a partially cutaway sectional view of the dual configuration storage container illustrated in FIG. 1, taken along section lines 2—2, showing a stacked series of seven foil packs of trading cards positioned within the third subcompartment of the box.
Figure 10:
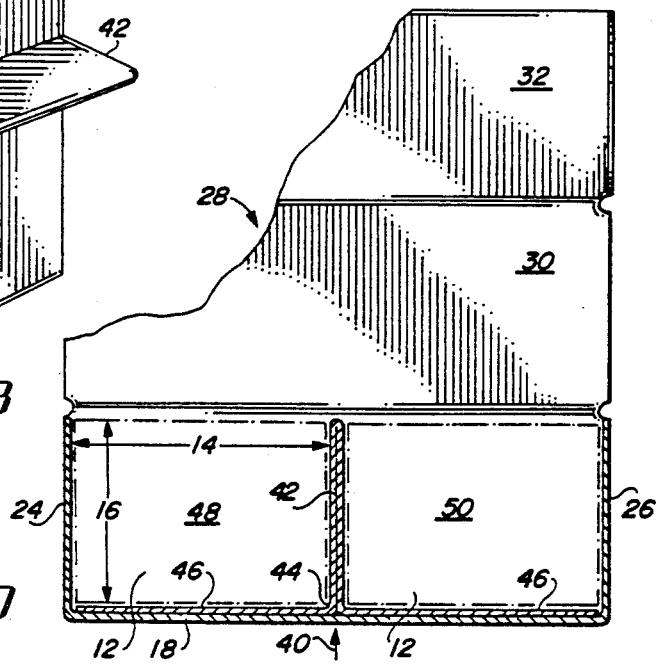
FIG. 10 is a sectional view of the dual configuration storage container illustrated in FIG. 9, taken along section lines 10—10, illustrating the manner in which the cards fit within the first and second equal size storage compartments.

Referring now to FIGS. 1, 2 and 10, a dual configuration storage container 10 is provided to store flat cards having a flat rectangular surface. As illustrated in FIG. 10, the rectangular perimeter surface of cards 12 includes a length designated by reference number 14 and a width designated by reference number 16. Such cards typically take the form of collectable cards such as baseball, basketball, football, hockey and cards related to other sports or even other subject matter of the type manufactured and sold by The Upper Deck Company of Carlsbad, Calif.

Box 10 includes a rectangular base surface 18, a rectangular front surface 20, a rectangular rear surface 22 which represents a substantially mirror image of front surface 20, and opposing, spaced apart rectangular end surfaces 24 and 26.

Figure 9:
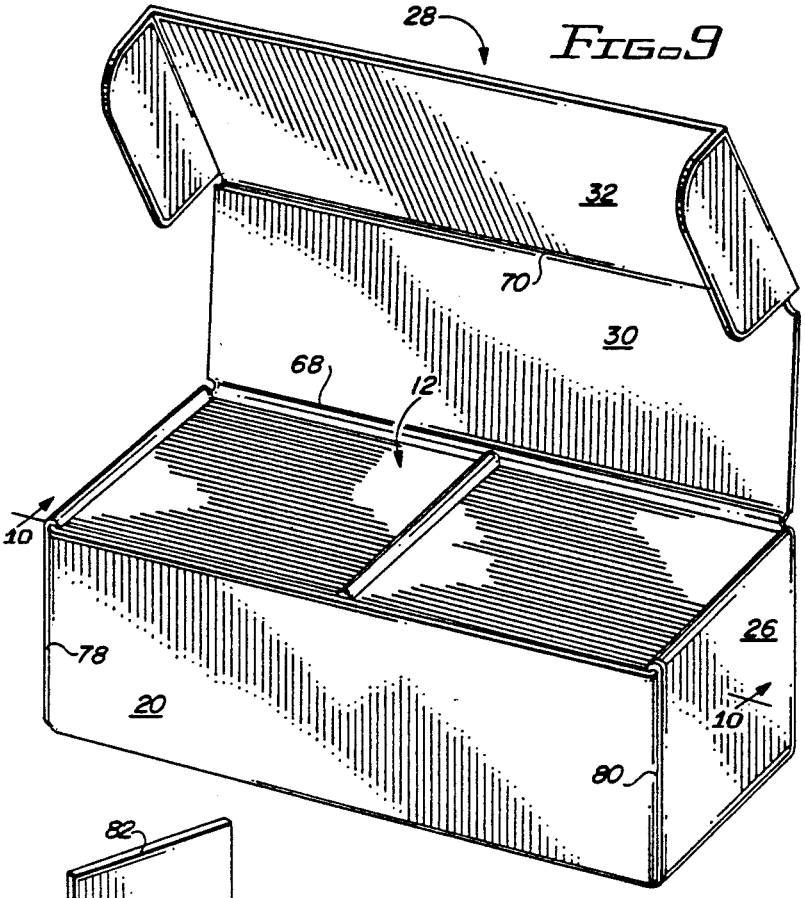
FIG. 9 illustrates the dual configuration storage container where the removable insert has been removed and the foldable divider has been configured in the extended position to define first and second equal size subcompartments for storing the maximum quantity of cards.

A top surface 28 is movable between an open position as illustrated in FIGS. 1 and 9 and a closed position. Top surface 28 includes a primary surface 30 and a secondary surface 32. When top surface 28 is moved into the closed position, primary surface 30 is oriented parallel to, but spaced apart from base surface 18. When top surface 28 is in the closed position, the box defines a rectangular internal storage compartment 34 having a length designated by reference number 36 (See FIG. 2), a width designated by reference number 38 (see FIG. 1) and a height commensurate with the height 16 (see FIG. 10) of the trading cards. Internal storage compartment 34 thereby defines a first storage volume for receiving the additional elements of the present invention which will be described below.

Base surface 28 includes a centrally located midline designated by reference number 40 in FIG. 10 which extends along the surface of the base between front surface 20 and rear surface 22, thereby dividing base surface 18 into two equal areas.

Referring now to FIGS. 2, 6, 7, 8 and 10, a foldable divider 42 includes a width substantially equally equal to the width 38 of internal storage compartment 34 and a length substantially equal to the height of internal storage compartment 38. Foldable divider 42 further includes a lower edge surface 44.

Figure 7:
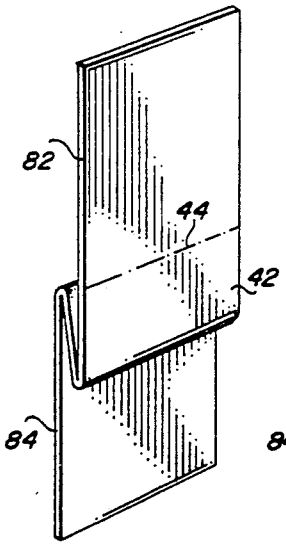
FIG. 7 is a perspective view of the foldable divider in the retracted position.
Figure 8:
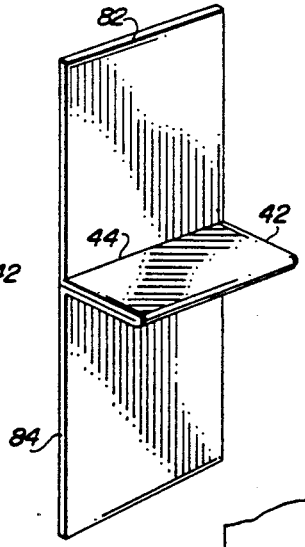
FIG. 8 is a perspective view illustrating the foldable divider in the extended position.

Foldable divider 42 may be moved or pivoted between an extended position illustrated in FIGS. 9 and 10 and a retracted position wherein foldable divider 42 is oriented substantially flush or parallel with base surface 18 as illustrated in FIGS. 2 and 7. In the extended position, foldable divider 42 is oriented substantially perpendicular to base surface 18 with lower edge surface 44 laterally aligned with midline 40 of base surface 18. When the foldable divider 42 is repositioned into the extended position as illustrated in FIGS. 9 and 10, box internal storage compartment 34 is subdivided into a first subcompartment 48 and a second subcompartment 50 of substantially equal volumes as illustrated in FIGS. 9 and 10.

Each subcompartment includes a length substantially equal to length 14 of each card and a height substantially equal to the height 16 of the card width. Because the length and height of subcompartments 48 and 50 are substantially equal to the length and width dimensions of the trading cards, subcompartments 48 and 50 are capable of storing a substantial quantity of trading cards when the card surfaces are oriented perpendicular to the box base surface 18 as illustrated in FIGS. 9 and 10.

For the specific application of storing Upper Deck trading cards, each storage compartment 48 and 50 is capable of storing 200 trading cards, providing a total box card storage capacity in the second configuration illustrated in FIGS. 9 and 10 of 400 cards.

Figure 5:
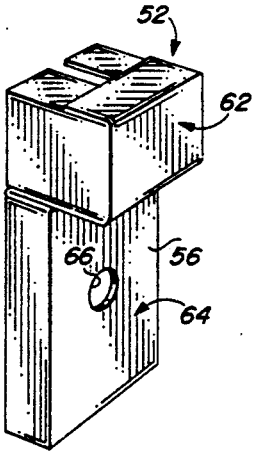
FIG. 5 is a perspective view of the removable insert in a configuration permitting its insertion into the box internal storage compartment.
Figure 6:
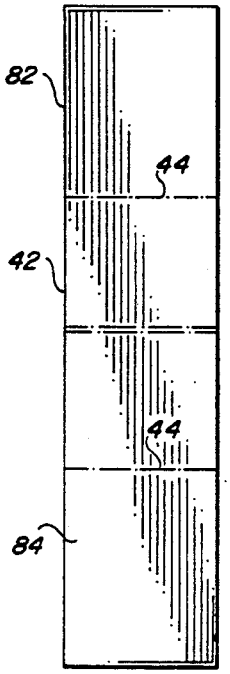
FIG. 6 is an elevational view of the foldable divider of the dual configuration storage container.

Referring now to FIGS. 1, 2 and 5, the dual configuration storage container includes a removable insert 52 which is dimensioned to fit snugly within internal storage compartment 34 of box 10. When disposed into internal storage compartment 34, removable insert 52 defines a third subcompartment 54 including a base surface 56 elevated above the box base surface 18. Third subcompartment 54 further includes a first side 58 and a second side (not shown) which are oriented parallel to the front and rear side surfaces 20 and 22 of box 10.

Base surface 56 of removable insert 52 includes a length equal to or greater than the card length 14 and serves to define the length of third subcompartment 54. The third side of third storage compartment 54 is defined by internal end surface 60 of removable insert 52 while a fourth side is defined by the interior surface of box end surface 26. The space between internal end surface 60 of removable insert 52 and box end surface 26 similarly defines a length equal to or greater than the length of cards 12.

The depth of third subcompartment 54 is defined by the spacing between base surface 56 of removable insert 52 and primary surface 30 of top surface 28. The depth of third subcompartment 54 may be varied but must be configured to store at least one card.

For card storage within third subcompartment 54, the flat surface of the card is oriented parallel to the box base surface 18.

As illustrated in FIG. 2, seven foil packages each including a total of twelve discrete cards can be stored with the flat surface of each card oriented parallel to the box base surface 18. In this particular application, the length of third storage compartment 54 must be slightly greater than the length of the cards to accommodate the increased length caused by the protruding, sealed end sections of the foil packages. For different applications, the length of third subcompartment 54 can be varied by controlling the length of base surface 56 relative to the remaining portion of removable insert 52.

In the removable insert 52 of the preferred embodiment of the invention illustrated in the patent drawings, removable insert 52 includes a first rectangular section 62 and a second rectangular section 64. First rectangular section 64 includes a width and a height approximately equal to the width and height of internal storage compartment 34. Second rectangular section 64 includes a width approximately equal to the width of internal storage compartment 34 with a height less than the height of internal storage compartment 34. The height differential between second rectangular section 64 and the height of internal storage compartment 34 serves to define the height or depth of third subcompartment 54.

To facilitate removal and insertion of removable insert 52 from internal storage compartment 34, a finger aperture 66 may be provided. Insertion of a finger into finger aperture 66 provides a readily accessed gripping point for a user to remove and discard removable insert 52 during the process of converting the dual configuration storage container 10 from the first configuration (low volume card storage configuration) illustrated in FIG. 1 into the second configuration (high volume card storage configuration) illustrated in FIG. 9.

Figure 3:
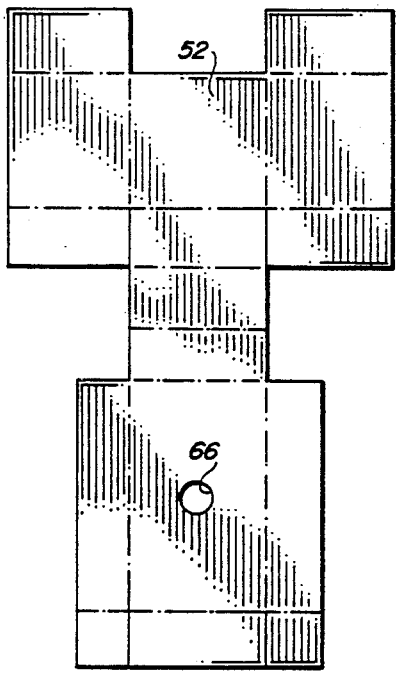
FIG. 3 is an elevational view illustrating the removable insert of the dual configuration storage container in the unfolded configuration.
Figure 4:
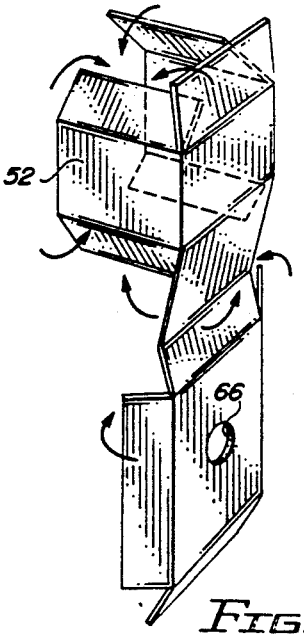
FIG. 4 represents a perspective view of the removable insert illustrated in FIG. 3, showing the manner in which a single sheet of material is folded to define the removable insert.

As illustrated in FIGS. 3 and 4, the first rectangular section 62 and second rectangular section 64 of removable insert 52 may be formed from a single sheet of material. By following the folding operation illustrated in FIG. 4, the single piece removable insert 52 can be readily formed at low cost by well known mechanical means. For such an application, removable insert 52 must be formed from a bendable material such as cardboard.

Referring now to FIGS. 1 and 9, top surface 28 of dual configuration storage container 10 includes primary surface 30 and secondary surface 32. Primary surface 30 includes a rectangular perimeter having an interior edge 68 pivotally coupled to an adjacent edge of box rear surface 22 and further includes an exterior edge 70. Primary surface 30 defines an area large enough to cover and close off internal storage compartment 34 when top surface 28 of box 10 is moved into the closed position.

Secondary surface 32 of top surface 28 includes an interior edge 72 pivotally coupled to exterior edge 70 of primary surface 30. Secondary surface 32 defines an area large enough to cover substantially the entire front surface 20 of box 10. As shown in the drawings, secondary surface 32 is formed as a rectangle including first and second linear end surfaces.

In the preferred embodiment of the invention illustrated in the drawings, secondary surface 32 further includes first and second securing flaps 74 and 76 which are coupled to the first and second end surfaces of secondary surface 32.

As illustrated in FIGS. 1 and 9, dual configuration storage container 10 includes first and second slots 78 and 80 formed along the junction between box front surface 20 and end surfaces 24 and 26. First and second slots 78 and 80 are dimensioned to receive first and second securing flaps 74 and 76 such that insertion of the securing flaps into the slots maintains top surface 28 of box 10 in the closed position and seals off and closes internal storage compartment 34.

Primary surface 30 and secondary surface 32 of top surface 28 may be formed from a single sheet of material. In the preferred embodiment of the invention, such material is configured as a bendable material and takes the form of cardboard.

The preferred embodiment of the foldable divider 42 includes first and second legs 82 and 84 as illustrated in FIGS. 2, 6, 7 and 8. The length of legs 82 and 84 is configured to equal approximately one half the length of internal storage compartment 34. Legs 82 and 84 serve to align lower edge surface 44 of foldable divider 42 with midline 40 of bottom surface 18 as illustrated in FIG. 10. To assist in maintaining foldable divider 42 in a fixed relative position within internal storage compartment 34, the width of legs 82 and 84 may be configured to approximately equal the width of internal storage compartment 34.

Foldable divider 44 and its legs 82 and 84 may be formed from a single sheet of bendable material such as cardboard and may be non-permanently positioned within the box. Alternatively, that assembly may be permanently secured within the box by adhesive materials or fastening devices of well known configurations.

The foregoing explanation demonstrates that the card storage capacity of dual configuration storage container 10 can readily be modified from the first storage configuration illustrated in FIG. 1 for storing a relatively low volume of cards into the second storage configuration illustrated in FIG. 9 for storing a substantially increased quantity of identical cards. In the preferred embodiment of the invention manufactured by The Upper Deck Company, seven foil packages of cards each including twelve cards for a total of eight-four cards can be stored in dual configuration storage container 10 in the first configuration illustrated in FIGS. 1 and 2. In the second storage configuration illustrated in FIGS. 9 and 10, four hundred trading cards can be stored.

The present invention can be manufactured inexpensively and readily facilitates conversion of the storage container from the low storage capacity first configuration into the high storage capacity second configuration. Although typically the product will be retailed in the first low capacity storage configuration and will be converted by the end user into the high capacity storage configuration, the end user can readily convert the dual configuration storage container back and forth between the first and second storage configurations.

It will be apparent to those skilled in the art that the disclosed dual configuration storage container may be modified in numerous ways and may assume many embodiments other than the preferred forms specifically set out and described above. For example, foldable divider 42 can take many different configurations such as a configuration having only a single rectangular insert which must be initially aligned and positioned by the user to define the dividing point between first subcompartment 48 and second subcompartment 50. Alternative means for pivotally coupling lower edge surface 44 of foldable divider 42 to an internal surface of box 10 may be provided rather than utilizing legs 82 and 84. Similarly, removable insert 52 may take the form of a single block of material rather than being fabricated from a single sheet of two dimensional material as illustrated. Accordingly, it is intended by the appended claims to cover all such modifications of the invention which fall within the true spirit and scope of the invention.

I claim:

1. A dual configuration storage container for flat cards having a rectangular surface, a length and a width, comprising:

a. a rectangular box having a rectangular base surface, a rectangular side surface, a rectangular rear surface with opposing, spaced apart rectangular end surfaces and a top surface movable between open and closed positions, the top surface oriented parallel to but spaced apart from the base surface when in the closed position, wherein the box defines a rectangular internal storage compartment having a first storage volume defined by a length, a width and height and wherein the base surface includes a midline extending between the front and rear surface for dividing the base surface into two equal areas;

b. a foldable divider having a width substantially equal to the width of the internal storage compartment and a length substantially equal to the height of the initial storage compartment, the divider having a lower edge surface and being movable between a retracted position substantially parallel to the base surface and an extended position oriented perpendicular to the base surface with the lower edge surface laterally aligned with the midline of the base surface for selectively subdividing the internal storage compartment into first and second equal size subcompartments when the foldable divider is displaced into the extended position, each subcompartment having a length substantially equal to the card length and a height substantially equal to the card width for storing cards with the card surfaces oriented perpendicular to the box base surface; and c. a removable insert dimensioned to fit snugly within the box internal storage compartment for defining a third compartment accessible through the top surface of the box when in the open configuration, the third subcompartment including a base surface elevated above the box base surface and having first and second sides oriented parallel to the front and rear surfaces of the box with a length equal to or greater than the length of the cards and third and fourth sides oriented parallel to the end surfaces of the box with a length equal to the width of the cards and a depth adequate to store at least one card with the card surface oriented parallel to the box base surfaced, whereby the card storage capacity of the box can be substantially increased by removing the removable insert and displacing the foldable divider from the retracted position into the extended position.

2. The dual configuration storage container of claim 1 wherein the foldable divider includes first and second legs extending laterally outward from the lower edge surface of the divider.

3. The dual configuration storage container of claim 2 wherein the internal storage compartment includes a length and a width, wherein the first and second legs include a length and a width and wherein the length of each of the first and second legs is approximately equal to one half of the length of the internal storage compartment.

4. The dual configuration storage container of claim 3 wherein the width of the first and second legs is approximately equal to the width of the internal storage compartment.

5. The dual configuration storage container of claim 2 or 3 wherein the foldable divider is not permanently attached to the box and can be removed from and inserted into the internal storage compartment.

6. The dual configuration storage container of claim 4 wherein the foldable divider and the first and second legs are formed from a single rectangular sheet of material.

7. The dual configuration storage container of claim 6 wherein the sheet of material is bendable.

8. The dual configuration storage container of claim 7 wherein the bendable material is cardboard.

9. The dual configuration storage container of claim 1 wherein the removable insert includes a first rectangular section and a second rectangular section.

10. The dual configuration storage container of claim 9 wherein the first rectangular section includes a width and a height approximately equal to the width and height of the internal storage compartment.

11. The dual configuration storage container of claim 10 wherein the second rectangular section includes a width approximately equal to the width of the internal storage compartment.

12. The dual configuration storage container of claim 11 wherein the second rectangular section includes a height less than the height of the internal storage compartment.

13. The dual configuration storage container of claim 12 wherein the second rectangular section includes a length approximately equal to or greater than the card length.

14. The dual configuration storage container of claim 13 wherein the second rectangular section includes an upper surface for supporting the cards.

15. The dual configuration storage container of claim 14 wherein the upper surface of the second rectangular section includes a finger aperture for facilitating removal of the removable insert from the internal storage compartment.

16. The dual configuration storage container of claim 13 wherein the first and second rectangular sections of the removable insert are formed from a single sheet of material.

17. The dual configuration storage container of claim 16 wherein the material is a bendable material.

18. The dual configuration storage container of claim 17 wherein the bendable material is cardboard.

19. The dual configuration storage container of claim 1 wherein the top surface of the box includes a primary surface and a secondary surface.

20. The dual configuration storage container of claim 11 wherein the primary surface of the box top surface includes a rectangular perimeter surface having an interior edge pivotally coupled to an adjacent edge of the box rear surface and further includes an exterior edge.

21. The dual configuration storage container of claim 20 wherein the primary surface defines an area large enough to cover and close off the internal storage compartment when the top surface is moved into the closed position.

22. The dual configuration storage container of claim 21 wherein the secondary surface of the box top surface includes an interior edge pivotally coupled to the exterior edge of the primary surface.

23. The dual configuration storage container of claim 22 wherein the secondary surface defines an area large enough to cover substantially the entire front surface of the box.

24. The dual configuration storage container of claim 24 wherein the secondary surface is formed as a rectangle, including first and second linear end surfaces.

25. The dual configuration storage container of claim 24 wherein the secondary surface further includes first and second securing flaps coupled to the first and second end surfaces.

26. The dual configuration storage container of claim 25 wherein first and second slots are formed along the junction the box front surface and each end surface.

27. The dual configuration storage container of claim 26 wherein the first and second slots are dimensioned to receive the first and second securing flaps.

28. The dual configuration storage container of claim 27 wherein insertion of the first and second securing flaps into the first and second slots maintains the top surface of the box in the closed position and seals off and closes the internal storage compartment of the box.

29. The dual configuration storage container of claim 28 wherein the primary surface, the secondary surface and the first and second securing flaps are formed from a single sheet of material.

30. The dual configuration storage container of claim 29 wherein the material is a bendable material.

31. The dual configuration storage container of claim 30 wherein the bendable material is cardboard.

* * * * *